US006127664A

United States Patent [19]

Eves, II et al.

[11] Patent Number: 6,127,664

[45] Date of Patent: Oct. 3, 2000

[54] MICROWAVE COMPLIANT AUTOMATICALLY SEALING OVEN DOOR

[75] Inventors: E. Eugene Eves, II, Westford, Mass.; Bruce Secovich, Hudson, N.H.

[73] Assignee: Ferrite Components, Inc., Hudson, N.H.

[21] Appl. No.: 09/406,905

[22] Filed: Sep. 28, 1999

Related U.S. Application Data

[62] Division of application No. 09/041,940, Mar. 13, 1998, Pat. No. 5,958,276.

[51] Int. Cl.[7] ..... H05B 6/76

[52] U.S. Cl. ..... 219/722; 219/739; 219/741

[58] Field of Search ..... 219/739, 740, 219/741, 722, 756, 699; 174/35 R

[56] References Cited

U.S. PATENT DOCUMENTS

| | | | |
|---|---|---|---|
| 2,762,893 | 9/1956 | Long et al. | 219/738 |
| 2,778,911 | 1/1957 | Valentine | 219/738 |
| 3,210,512 | 10/1965 | Eason | 219/741 |
| 3,381,605 | 5/1968 | Smith | 219/739 |
| 3,566,066 | 2/1971 | Borthwick et al. | 219/739 |
| 4,201,901 | 5/1980 | Schuchert | 219/739 |
| 4,219,716 | 8/1980 | Kaufman, Jr. et al. | 219/739 |
| 4,246,462 | 1/1981 | Meisel | 219/700 |
| 4,390,767 | 6/1983 | Bucksbaum et al. | 219/740 |
| 5,767,492 | 6/1998 | Pinceloup | 219/699 |

FOREIGN PATENT DOCUMENTS

| | | | |
|---|---|---|---|
| 54-15543 | 2/1979 | Japan | 219/739 |
| 4-138687 | 5/1992 | Japan | 219/739 |

*Primary Examiner*—Philip H. Leung
*Attorney, Agent, or Firm*—Hamilton, Brook, Smith & Reynolds, P.C.

[57] ABSTRACT

A door assembly for a microwave oven that includes a deformable thin stainless steel plate which is sandwiched between a compression frame and a choke structure. To open the door, the plate is moved upward and away from the compression plate and the choke. In the closed position, the compression plate is pressed back under tension against the choke by the compression frame to prevent leakage of microwave energy. Tension force may be applied, for example, by the use of angled flanges or pneumatic door clamps. The door assembly is readily adaptable to both batch type and continuous feed processing. Because of the single moving lightweight plate, the assembly achieves a low cycle time access opening, eliminates the need for heavy and cumbersome structures which in turn also reduces the potential for injury.

3 Claims, 10 Drawing Sheets

MICROWAVE COMPLIANT AUTOMATICALLY SEALING OVEN DOOR

RELATED APPLICATIONS

This is a divisional application of U.S. application Ser. No. 09/041,940, filed on Mar. 13, 1998, U.S. Pat. No. 5,958,276, the entire teachings of which are incorporated herein by reference.

BACKGROUND OF THE INVENTION

Microwave ovens, now a permanent fixture in many homes, also increasingly find use in high volume industrial applications. For example, the tempering of large quantities of frozen meat, fish, poultry, and fruit is greatly enhanced with the use of microwave ovens. Not only do they provide for greater uniformity in tempering, they also eliminate several hour wait times to thaw a frozen product prior to its availability for use while minimizing drip loss and improving sanitation.

Just as with units designed for domestic use, industrial microwave ovens must be appropriately designed to prevent leakage of microwave energy from the cavity during operation. Compliance with government safety regulations is increasingly difficult with such units as general concerns about high doses of radiation increases. Ii is not uncommon for an industrial microwave oven, which may, for example be required to process several hundred kilograms of product in a several minute time span, to generate radio frequency energy levels of 50 kilo Watts (kW) or more. In addition, the proliferation of various types of wireless consumer devices such as cellular telephones which operate using milliwatt (mW) radio frequency power levels at microwave frequencies have prompted government agencies in several countries to further limit the acceptable amounts of radiation emanating from an oven.

Many different techniques have been developed to limit the amount of energy which is spuriously emitted by a microwave oven. Perhaps the most popular way is to seal the door of the oven with some type of radio frequency choke structure. Most such seals use the so-called one quarter wavelength blocking principle whereby a conductive choke structure is placed around the periphery of the door adjacent where the door meets the cavity when closed. The choke is designed such that conductive material is gapped at predetermined intervals equal to one quarter of the wavelength of the energy to be blocked. Simply placing a quarter wavelength choke within the door, being relatively inexpensive and straightforward to manufacture, is quite adequate for the domestic oven market.

However, the operating environments for commercial microwave ovens are far more stringent and thus require that additional measures be taken into consideration. Commercial ovens must typically be provided with a door that uses minimal floor space when opened, while at the same time providing maximum access for cleaning. And the spacing between door components and the oven cavity must be maintained over distances as large as a meter or more across. In addition, the effectiveness of the choke must not degrade over many hundreds of rapid open and close cycles. Indeed, in the past some have found it necessary to design oven doors which have mechanisms for adjusting the spacing between the door and the cavity in the field.

SUMMARY OF THE INVENTION

The present invention is a compliant door for a microwave oven such as is used in commercial applications that includes a flexible, deformable, flat, easily movable surface such as a thin stainless steel plate. The plate is sandwiched between a compression frame and a choke structure disposed in the periphery of the end of the processing cavity.

In the open position, the plate is moved away from the compression plate and the choke. In the closed position, the compression plate is pressed back under tension against the choke by the compression frame. Tension may be provided by various techniques for applying force to the plate that provide an intimate fit of the plate, indeed, even deforming the plate as necessary, to cause the plate to conform to the choke. Compression force may be applied, for example, by the use of angled flanges or pneumatic door shoe clamps which are activated by air cylinders.

The door is preferably mechanically operated in a vertical plane adjacent the choke opening such as by a door raise air cylinder. The raise cylinder drops the plate down to close the door and lifts the plate up to open the door. Alternatively, the door may drop down to be opened and raised to be closed.

In the open position, product to be processed by the oven may be placed into the cavity through an opening formed in the compression frame.

The invention is readily adaptable to batch type processing wherein a single door provides access into the microwave cavity enclosure.

In addition, the door may be applied to continuous feed type arrangements wherein two doors are placed on either end of a microwave cavity enclosure.

The entire structure including the compression frame, plate, and attendant apparatus such as the raise cylinder may be mounted via hinges along a bottom portion of the microwave cavity enclosure to provide maximum access to the cavity for cleaning.

The door assembly is operated as follows. The door starts in a lowered and clamped position. An opening cycle starts such as by releasing the door clamp cylinders. The compression frame than swings away under spring force from the flanges or by operating the compression shoe cylinders. The motion of the compression frame may at this point cause a magnetic interlock to disengage, thereby preventing the source of microwave energy from activating. The door raise cylinder is then activated, driving the door beyond the cavity opening until the upper limit switch mounted on the air cylinder is reached. The product may than enter and exit may cavity at this time. A closing cycle starts with the door cylinder releasing, allowing gravity to pull the door closed. Upon activation of a lower limit switch mounted in the air cylinder, the door clamp cylinders are engaged. When the compression frame is in position, the magnetic interlock in turn engages, allowing the microwave energy source to again be activated. The door assembly is now in its starting position.

Various arrangements to operate the compression frame can also be used. For example, the air cylinders can be double acting, requiring air activation to open the compression frame instead of spring pressure. The door cylinders can also be driven down with air pressure to speed the close cycle.

Rotary actuators or lead screws may be used in place of the door raise cylinder.

The invention provides several advantages over the prior art. For example, it provides predictable electrical leakage properties even after many open and close cycles. The invention also achieves a low cycle time access opening for a microwave oven cavity. This is accomplished while also meeting the stringent microwave energy leakage requirements of the European Community CISPR II electromagnetic interference standard which is incorporated herein by reference.

The door eliminates the need for heavy and cumbersome structures that include chokes and stiffening components that move with the door. As a result the door may be implemented with greatly reduced moving mass. This is accomplished by the combination of relocating the choke to a fixed position at the end of cavity structure, and reducing the moving parts of the door to the single light weight piece of sheet metal.

As a result of reducing the overall mass of the door, which can typically weigh as little as 10 kilograms, a passive safety aspect of the invention is also provided, since lower operational forces are required to operate the door, which in turn reduce the potential for injury.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF A PREFERRED EMBODIMENT

Figure 1:
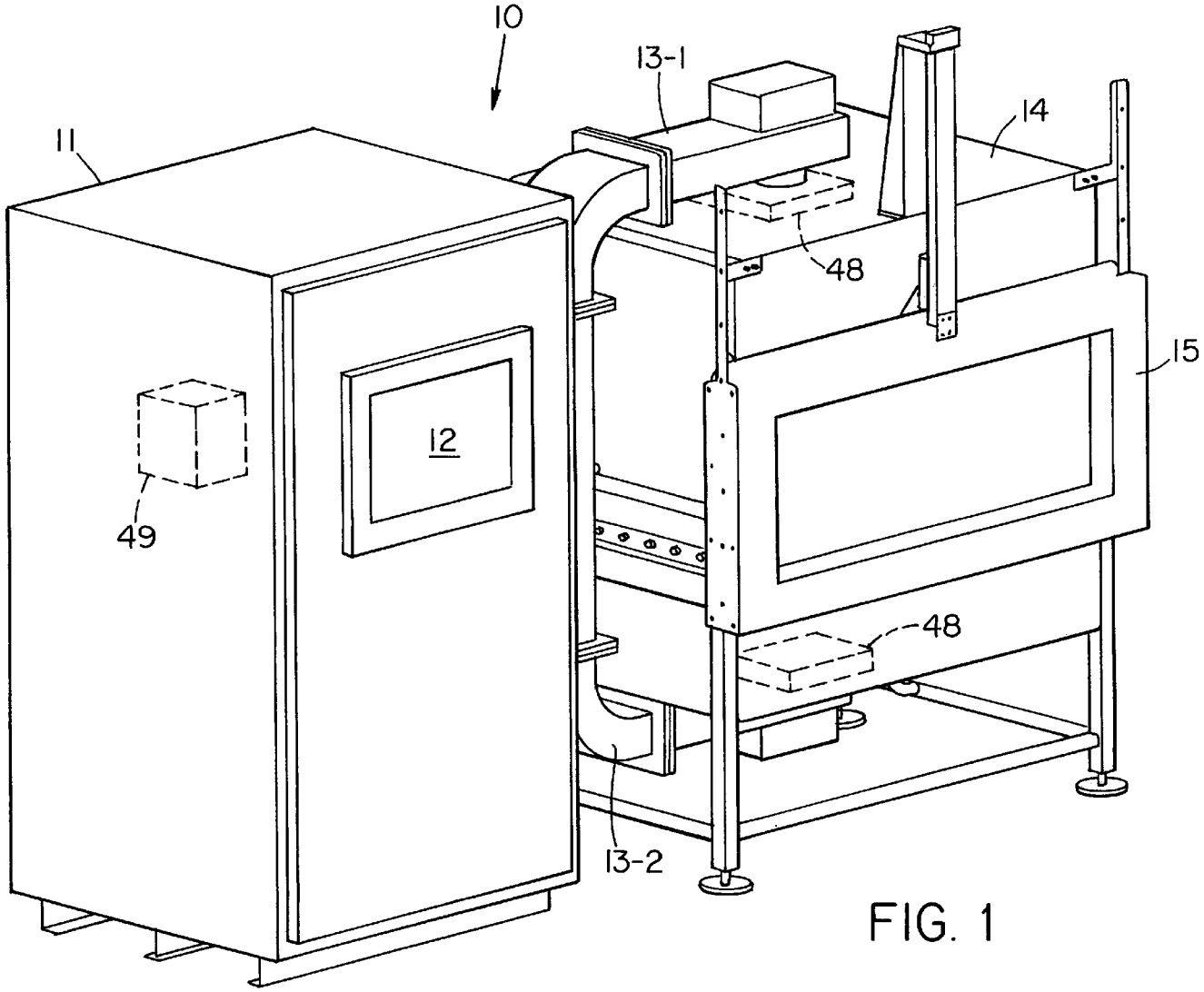
FIG. 1 is a perspective view of a batch-type microwave oven which includes a compliant door according to the invention.

Turning attention now to the drawings more particularly, FIG. 1 illustrates a microwave oven for batch processing or batch oven 10 which makes use of a door assembly according to the invention. The batch oven 10 includes a cabinet 11 which encloses a source of microwave energy. A control panel 12 is disposed on the outer surface of the cabinet 11, which also houses control electronics. Wave guides 13-1 and 13-2 provide microwave energy from the energy source 49 to the interior of the cavity enclosure 14 typically through radiators 48. Wave guides 13-1 and 13-2 couple energy typically to both the top and bottom of the cavity enclosure 14.

The present invention is in the manner of implementing a door assembly 15 which opens and closes in a generally vertical direction to provide access to the interior of the cavity enclosure 14.

Figure 2:
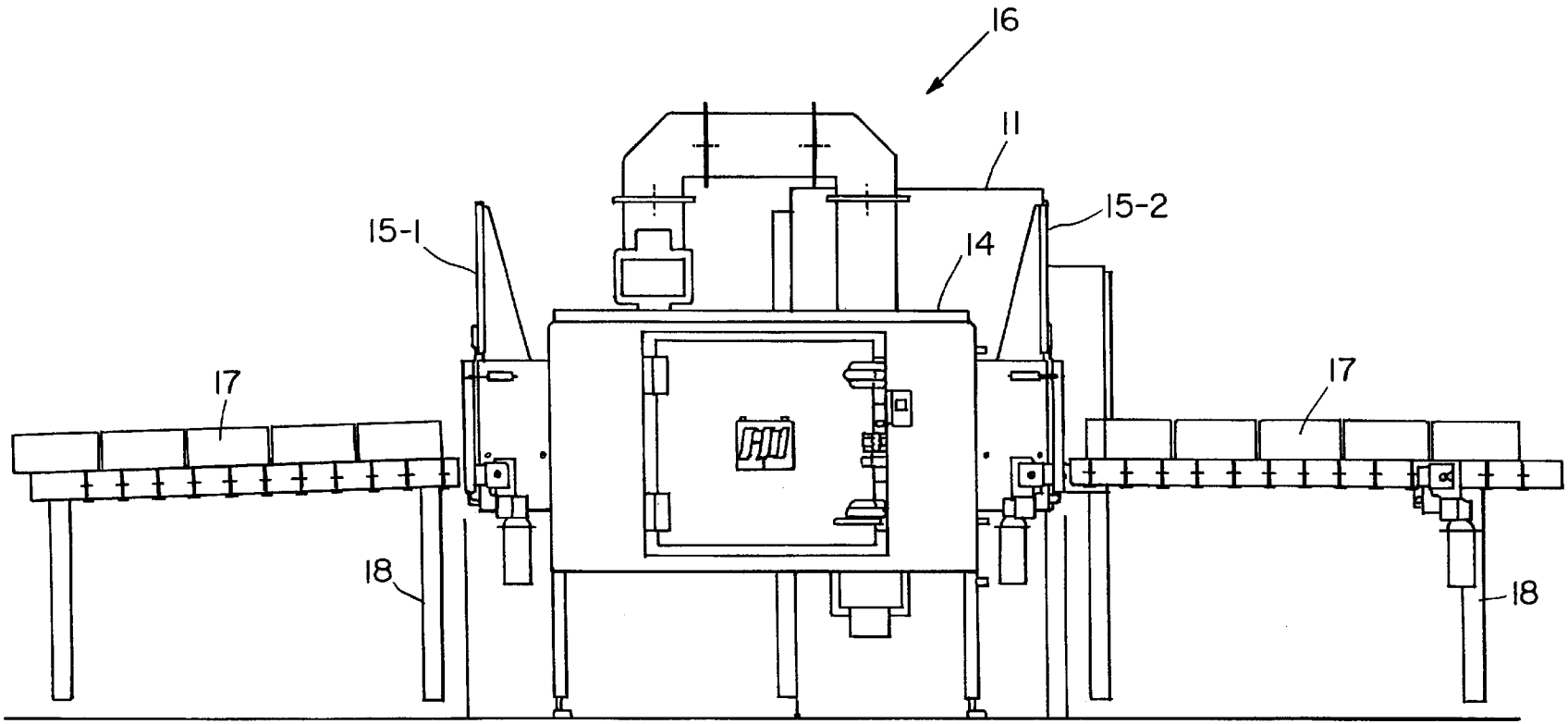
FIG. 2 is a side view of a continuous feed-type microwave oven which includes a pair of doors on either end of a cavity enclosure according to the invention.

The door assembly 15 may also be used in a continuous feed type microwave oven as shown in the side view of FIG. 2. In this arrangement a pair of doors 15-1 and 15-2 are disposed on either end of the cavity enclosure 14. Pallets or boxes may hold the product 17 to be processed. Load tables 18 encompassing rollers convey the product pallets 17 into and out of the continuous feed oven 16 automatically, such as under motor control.

Figure 3:
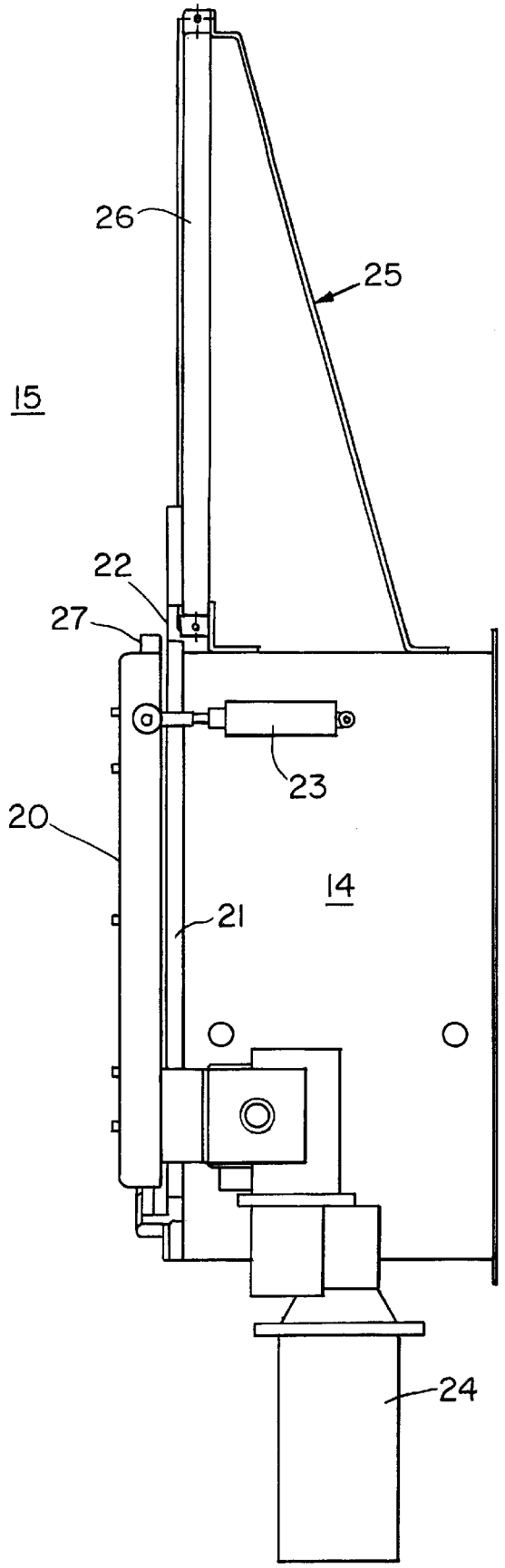
FIG. 3 is a more detailed side view of a door assembly.

FIG. 3 shows a more detailed view of a door assembly 15 such as disposed on the left end of the continuous feed oven of FIG. 2. The door assembly 15 consists of a outer portion that serves as a compression frame 20. A microwave choke assembly 21 is disposed on the outer periphery of an opening 29 (FIG. 5) in the cavity enclosure 14. A compliant plate 22 is laterally disposed between the choke 21 and compression frame 20 in a manner which is further described in greater detail below. These components of the door assembly 15 are mostly formed of stainless steel or other material suitable for food processing applications.

A door clamp cylinder 23 is fixed to the outer side of the cavity enclosure 14, piston controls the open and closed positions of the compression frame 20. In the preferred environment a door clamp cylinder 23 is located on each side of the compression frame 20 and cavity enclosure 14.

A motor 24 disposed in the lower portion of the enclosure 14 provides for moving the product 17 into and out of the enclosure 14.

A support 25 provides physical stability for a door raise cylinder 26 that is coupled to the compliant plate 22. A magnetic interlock 27 is disposed adjacent the plate 22 to confirm when the plate 22 is in the lowered and locked position.

Figure 4:
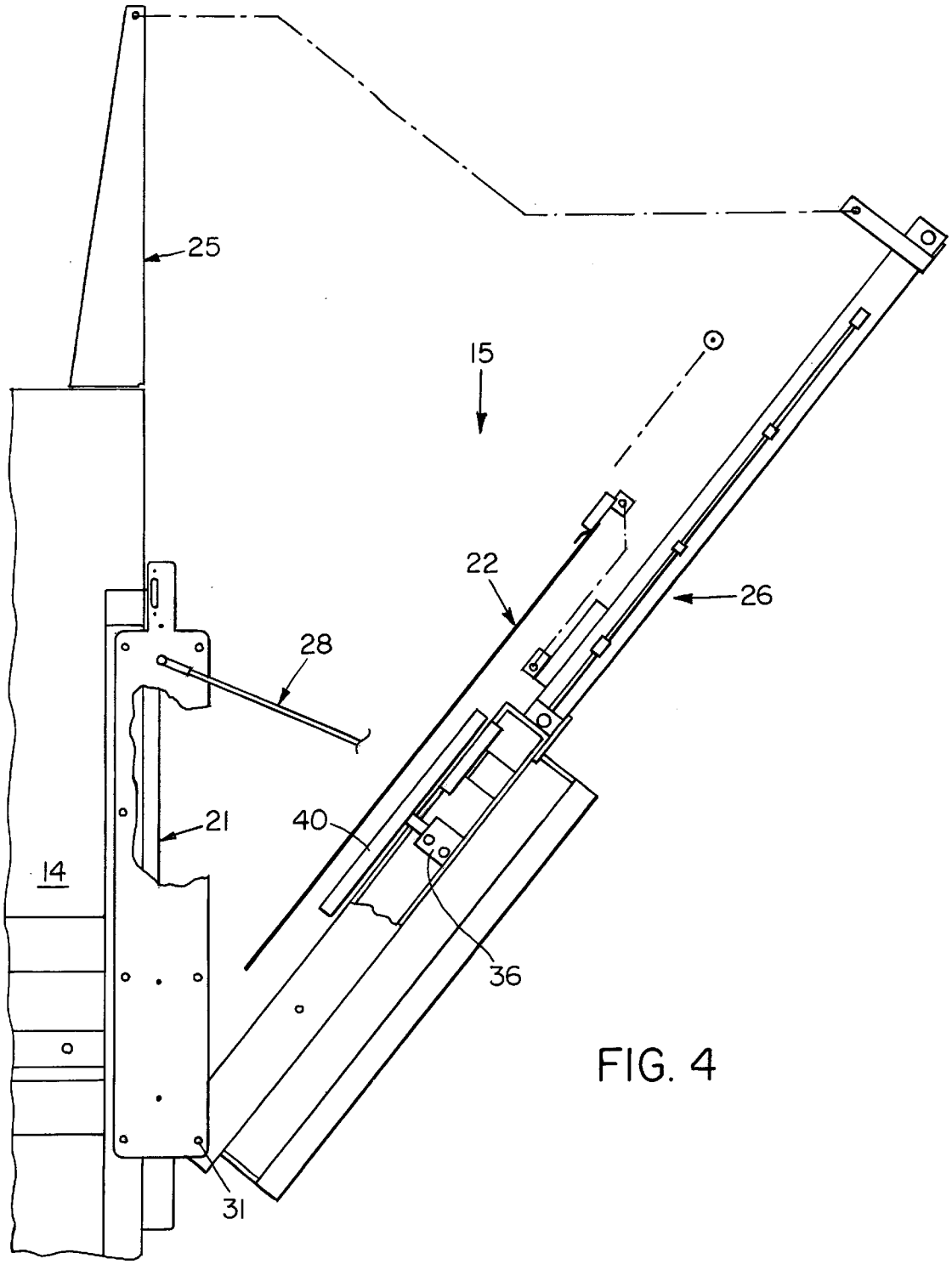
FIG. 4 is an partially cut away and exploded side view of the door.

FIG. 4 is a side view of a door assembly 15 showing many of the same components, including in particular a plate 22 in greater detail. Hinges 31 disposed at the bottom of the door assembly 15 permit the door assembly 15 to swing completely open for cleaning the cavity 14. When the door assembly 15 is dropped down for maximum access to the interior of the cavity 14 such as is required for cleaning, a wire cable 28 serves as a lanyard to further secure the door assembly 15 as a safety factor.

In this embodiment, the compression frame 20 makes use of compression shoes 40 as will be described further in detail below. In this view the choke 21 is more readily seen with the portions of the enclosure 14 cut away. Suitable fasteners are used to connect the plate 22 to the door raise cylinder 26.

It should be understood that FIGS. 2, 3, 5 and 7 herein relate to one embodiment of the invention using flanges 30 whereas FIGS. 4, 8, 9 and 10 relate to an embodiment using compression shoes 40.

Figure 5:
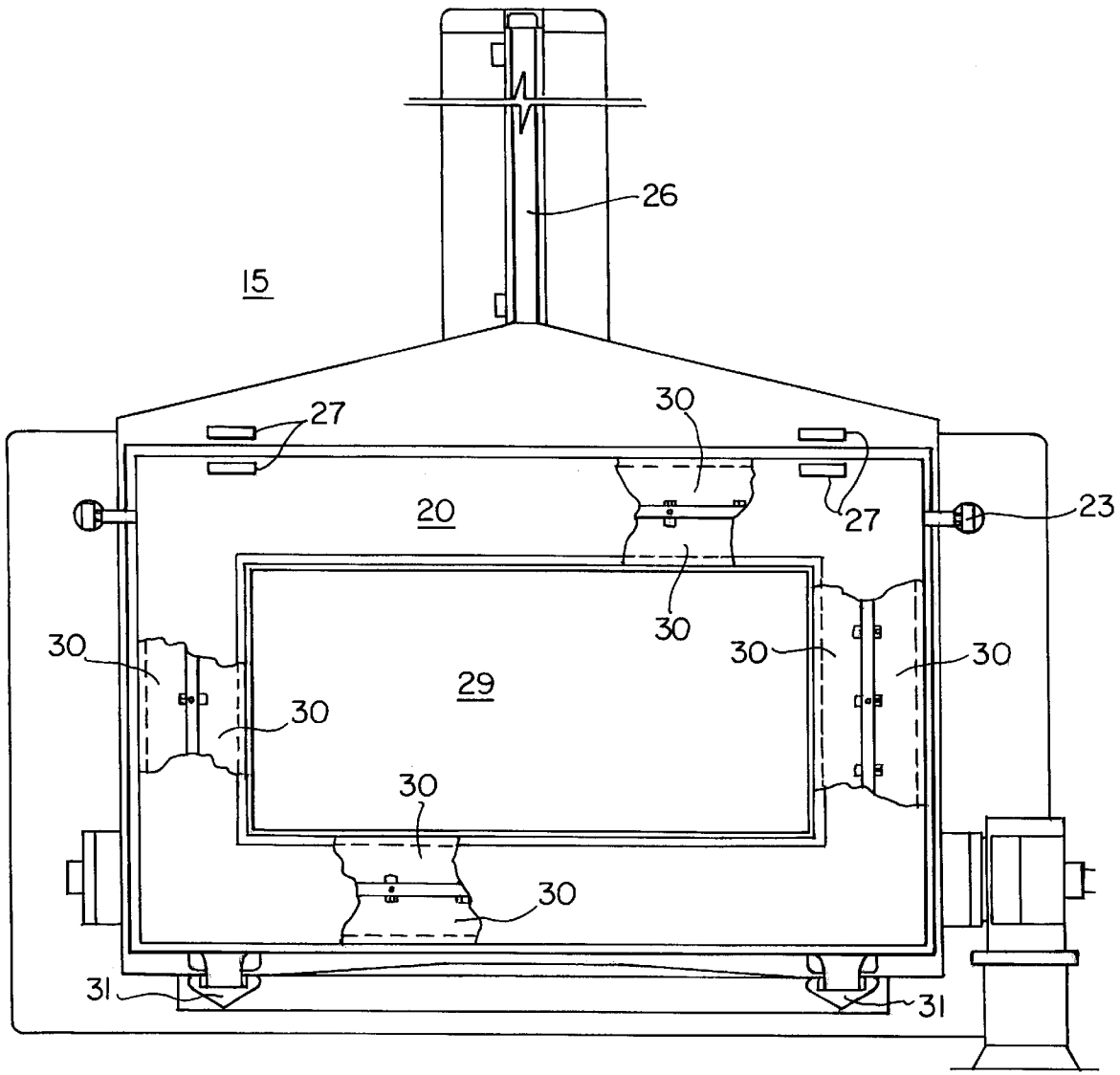
FIG. 5 is a front plan view of one embodiment of the door.

FIG. 5 is a front view of a door assembly 15, being partially cut away to show additional details of a compression frame 20. In this view the electromagnetic interlocks 27 are more readily seen.

The compression frame 20 includes an opening 29 in the middle thereof so that product may pass there-through into cavity enclosure 14 for processing. In this embodiment a pair of flanges 30 are disposed around the perimeter of the compression frame 20 on an inner portion thereof.

Referring now to FIGS. 3 and 5 together, the door assembly 15 is operated as follows. The door starts in a lowered and clamped position. An opening cycle starts by releasing the door clamp cylinders 23. The compression frame 20 then swings away under spring force from the flanges or by operating the shoe cylinders 23. The motion of the compression frame 20 may at this point cause the magnetic interlock 27 to disengage, thereby preventing the source of microwave energy from activating.

The door raise cylinder 26 is then activated, driving the plate 22 beyond the cavity opening 29 until the upper limit switch mounted on the raise cylinder 26 is reached. The product may than enter and exit the cavity through the opening 29 in the compression frame 20 at this time.

A closing cycle starts with the door raise cylinders 26 releasing, allowing gravity to pull the plate 22 down to the closed position. Upon activation of a lower limit switch, the door clamp cylinders 23 are engaged. When the compression frame 20 is in position, the magnetic interlock 27 in turn engages, allowing the microwave energy source to again be activated. The door assembly 15 is now in its starting position.

It should also be understood that the door raise cylinder may be instead positioned at the bottom of the unit. In this case, the plate 22 drops down to open under the force of gravity and is then pushed up to close.

Figure 6:
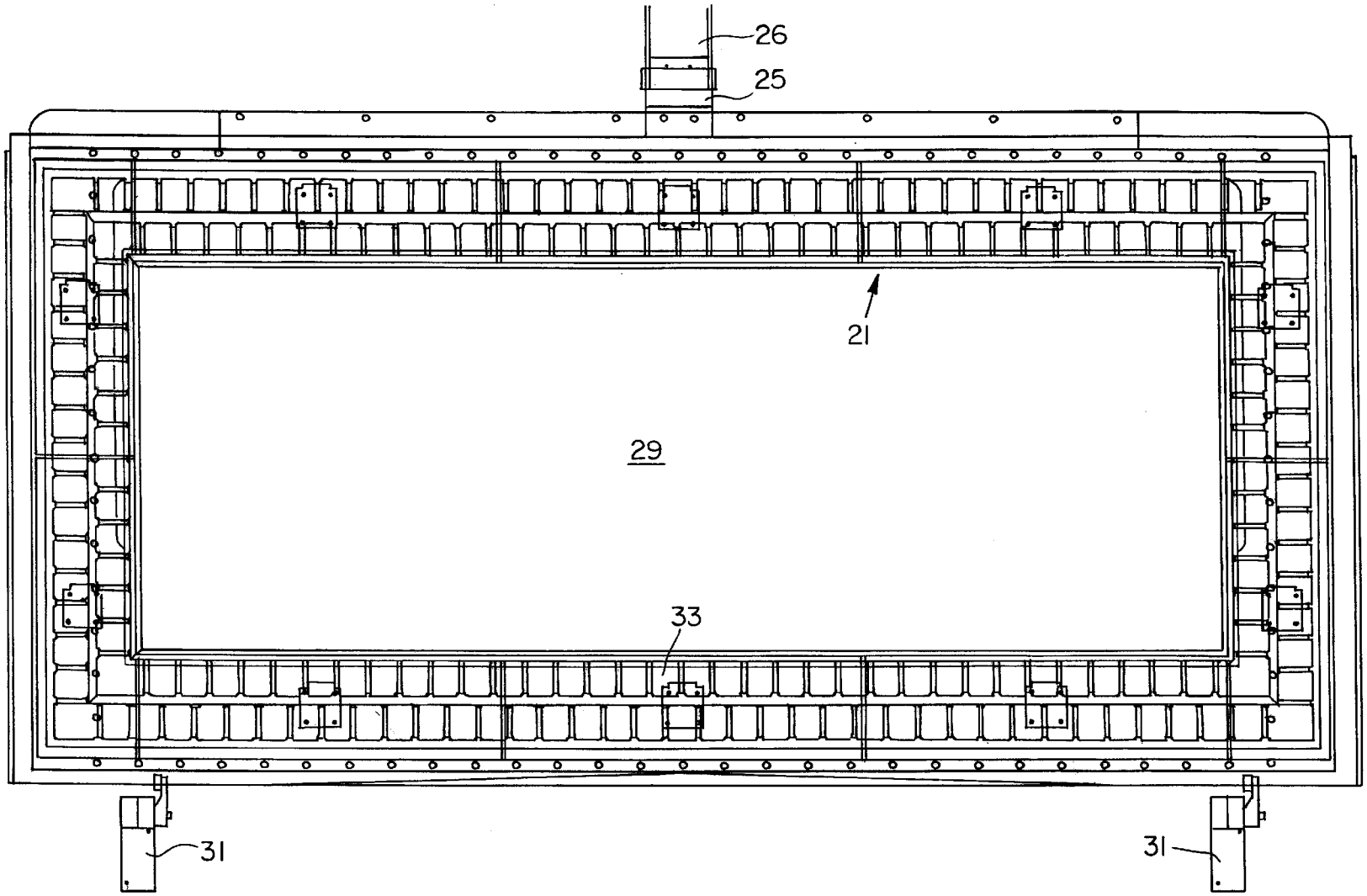
FIG. 6 is a cut away view of the cavity opening showing the choke structure.

FIG. 6 shows a partially cut away view of the opening 29 in the cavity enclosure 14 as seen from the front. The conductive choke 21 consists of a number of conducting fingers 33 disposed around the opening 29 in manner which is well known in the art to provide a quarter wavelength radio frequency block. The conductive fingers 33 are typically enclosed in silicone rubber or other suitable material to prevent food, dirt and other foreign material from fouling the choke 21.

Figure 7:
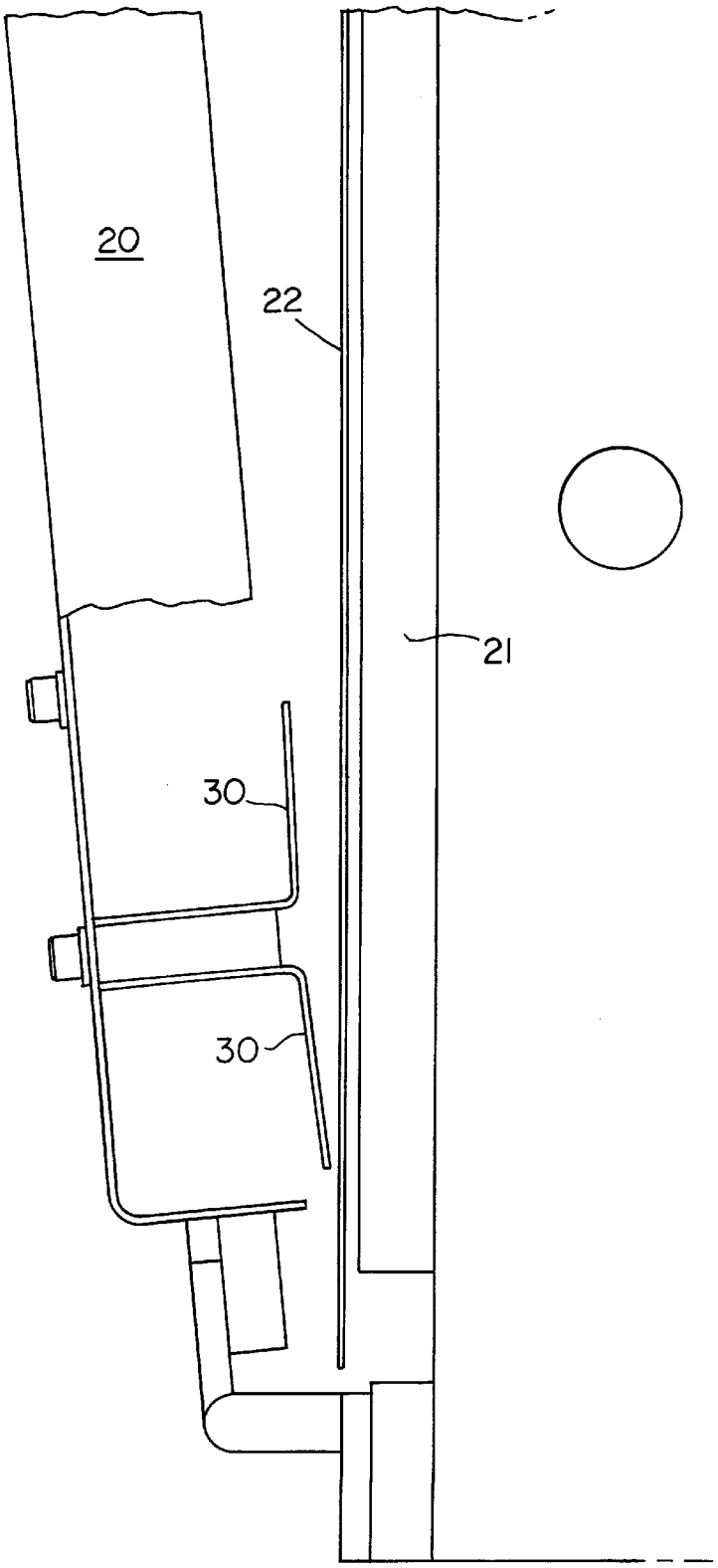
FIG. 7 is a detailed view of one embodiment of the door showing the compression frame, plate, and choke in greater detail.

FIG. 7 illustrates a more detailed cut away view of one embodiment of the compression frame 20. This embodiment uses the flanges that were shown in FIG. 5, specifically implemented as a pair of opposing horizontal flanges 30. The flanges are angled outboard in a range from about 90 to 94 degrees, preferably at 92 degrees. The flanges 30 provide a compression force to urge the plate 22 against the choke 21 when the compression frame 20 is placed in the closed position by the door clamp cylinders 23.

Figure 8:
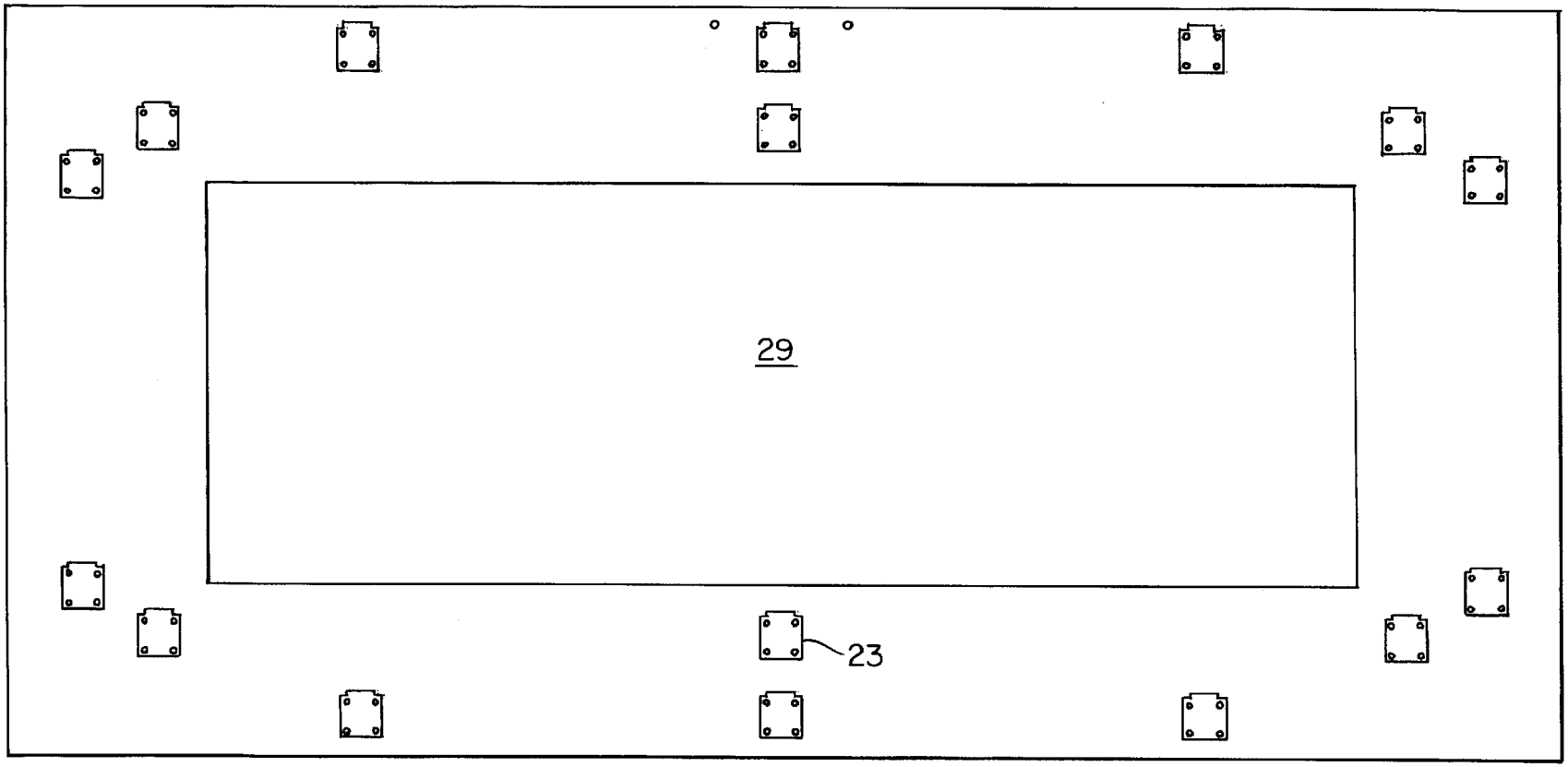
FIG. 8 is a plan view of the compression frame showing an alternate embodiment which uses pneumatic actuators.

FIG. 8 shows an alternate embodiment for providing the compression of the plate 22 against the choke 21. In this technique, compression shoes are disposed within the compression frame 20 on all four sides thereof. In this illustrated embodiment sixteen clamping cylinders 23 drive compression shoes symmetrically disposed about the frame.

Figure 9:
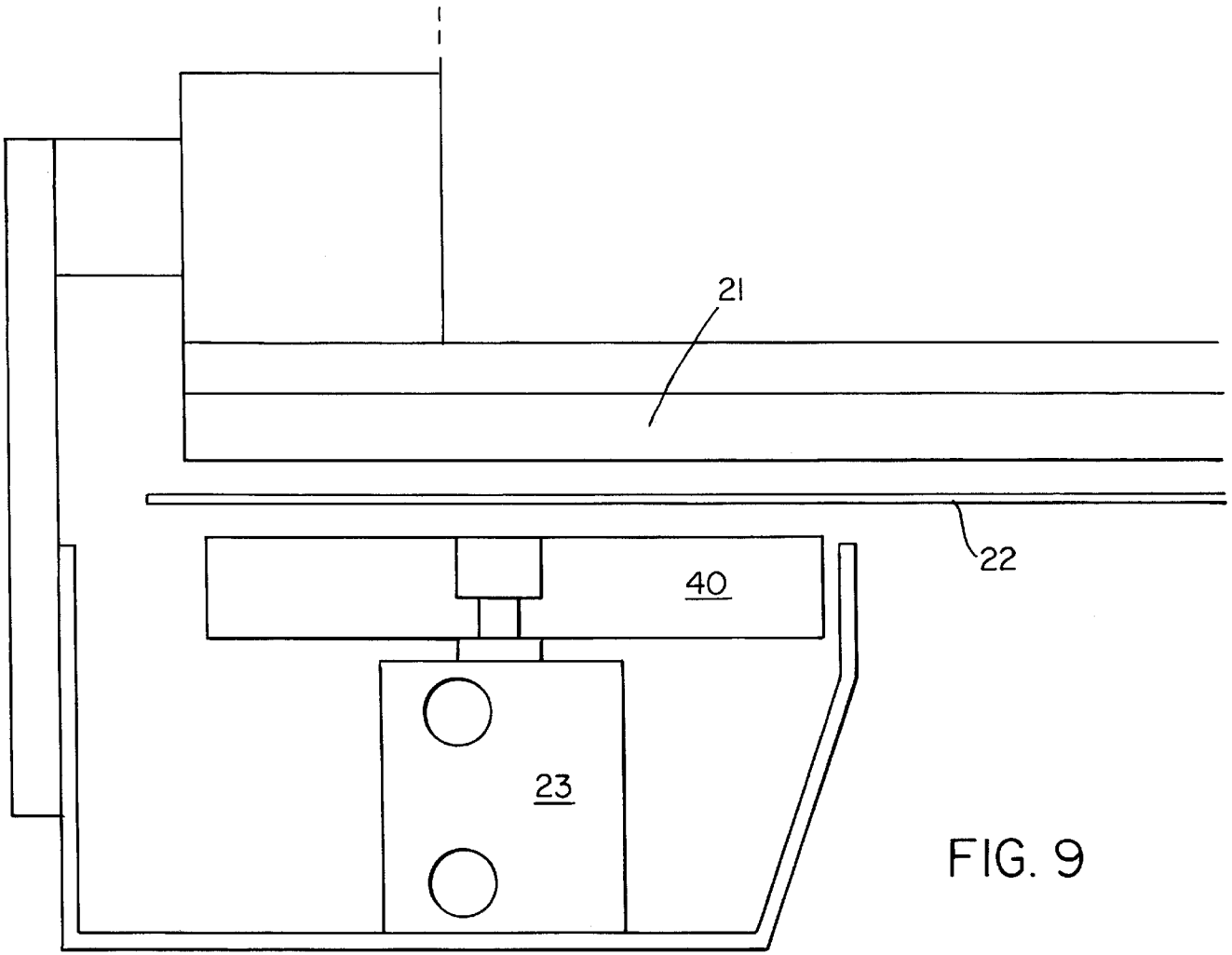
FIG. 9 is a cross sectional view take from above showing the compression frame with a puck type pneumatic actuator.

FIG. 9 is a cut away view taken from atop the door assembly 15 showing a compression shoe 36 in more detail. The exemplary compression shoes 40 is driven by the pneumatic actuated 13. Upon activation such as when it is desired to clamp the door assembly 15, the shoe 40 is pushed into intimate contact with the plate 22 against the choke 21.

Figure 10:
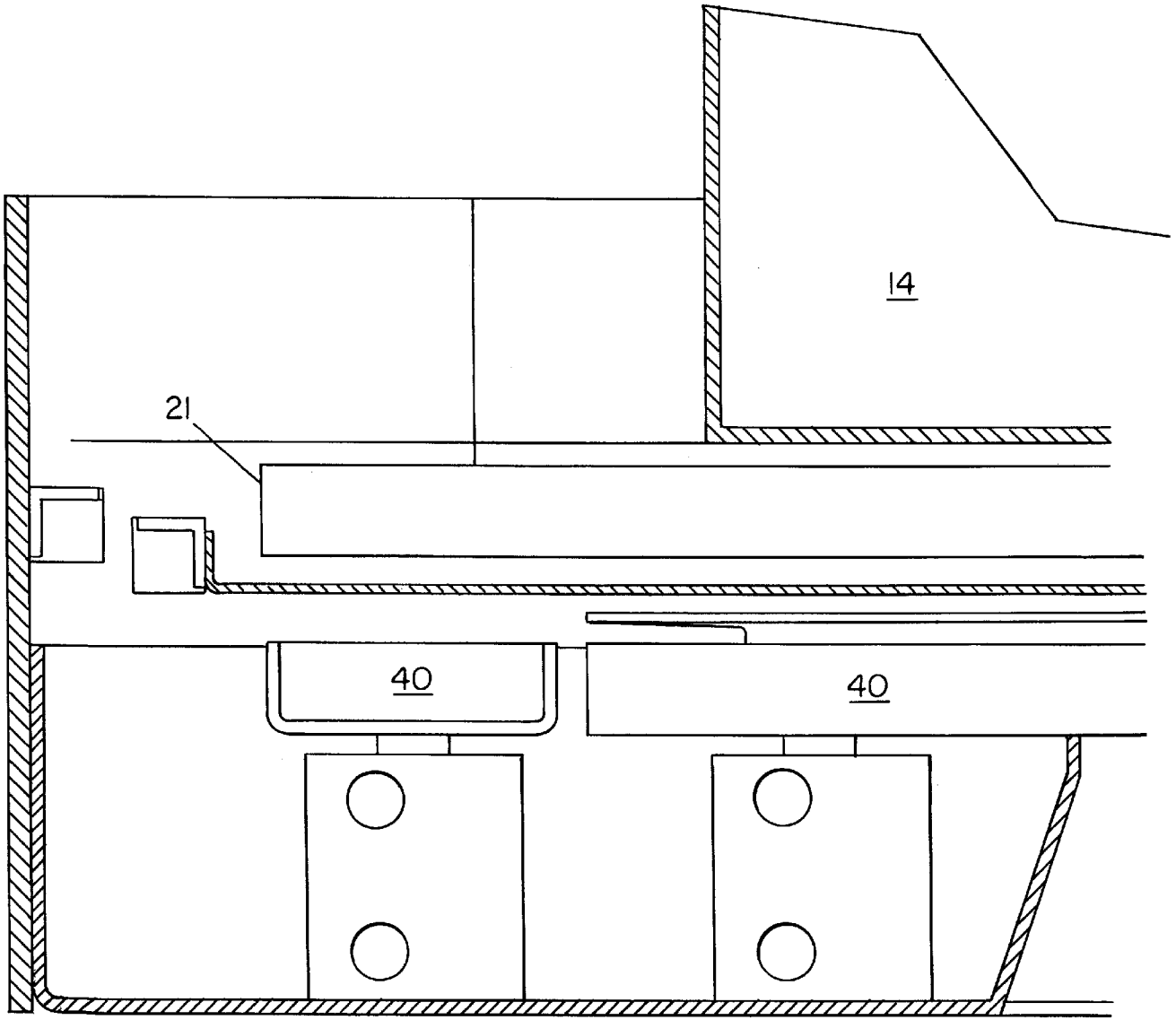
FIG. 10 is a similar cross sectional view of another embodiment of the compression frame showing bar type pneumatic actuators.

FIG. 10 shows another embodiment of a similarly pneumatically actuated compression frame 20 making use of elongated or bar-type compression shoes 40. These typically are run along the entire edge of the respective side of opening 29.

EQUIVALENTS

While this invention has been particularly shown and described with references to preferred embodiments thereof, it will be understood by those skilled in the art that various changes in form and details may be made therein without departing from the spirit and scope of the invention as defined by the appended claims. Those skilled in the art will recognize or be able to ascertain using no more than routine experimentation, many equivalents to the specific embodiments of the invention described specifically herein. Such equivalents are intended to be encompassed in the scope of the claims.

What is claimed is:

1. A method of operating a door assembly of a microwave oven cavity having an access opening, the door assembly comprising a compression frame having an opening, a door plate and a choke structure, comprising the steps of:

(a) releasing at least one door clamp cylinder to cause the compression frame to swing away from the cavity access opening;

(b) activating a door plate cylinder to drive the door plate beyond the cavity access opening; and (c) placing product to be subjected to microwave energy through the opening formed in the compression frame into the oven cavity.

2. A method as in claim 1 additionally comprising the steps of:

(e) activating the door plate cylinder to pull the door plate down to a closed position adjacent the cavity access opening; and (f) activating the door clamp cylinder to cause the compression frame to engage the door plate thereby causing the door plate to contact the choke structure surrounding the cavity access opening.

3. A method as in claim 1 additionally comprising the steps of:

(e) activating the door plate cylinder to raise the plate up to a closed position adjacent to the cavity access opening; and (f) activating the door clamp cylinder to cause the compression frame to engage the door plate thereby causing the door plate to contact the choke structure surrounding the cavity access opening.

* * * * *